US011252489B2

(12) United States Patent
Miao

(10) Patent No.: US 11,252,489 B2
(45) Date of Patent: Feb. 15, 2022

(54) LOUDSPEAKER MODULE

(71) Applicant: GOERTEK INC., Shandong (CN)

(72) Inventor: Qing Miao, Shandong (CN)

(73) Assignee: GOERTEK INC., Weifang (CN)

( * ) Notice: Subject to any disclaimer, the term of this patent is extended or adjusted under 35 U.S.C. 154(b) by 0 days.

(21) Appl. No.: 16/959,000

(22) PCT Filed: Oct. 25, 2018

(86) PCT No.: PCT/CN2018/111839
§ 371 (c)(1),
(2) Date: Jun. 29, 2020

(87) PCT Pub. No.: WO2019/128424
PCT Pub. Date: Jul. 4, 2019

(65) Prior Publication Data

US 2020/0336810 A1 Oct. 22, 2020

(30) Foreign Application Priority Data

Dec. 29, 2017 (CN) ..... 201721920883.3

(51) Int. Cl.
*H04R 1/02* (2006.01)

(52) U.S. Cl.
CPC ..... *H04R 1/02* (2013.01)

(58) Field of Classification Search
CPC ..... H04R 9/04; H04R 9/043; H04R 7/122; H04R 11/08; H04R 11/04; H04R 11/02;
(Continued)

(56) References Cited

U.S. PATENT DOCUMENTS 10,231,041 B2 3/2019 Miao et al.
2010/0032232 A1* 2/2010 Lim ..... H04R 5/02 181/141

(Continued)

FOREIGN PATENT DOCUMENTS

CN 1765150 A 4/2006
CN 104519449 A 4/2015

(Continued)

OTHER PUBLICATIONS

International Search Report from International Application No. PCT/CN2018/111839 dated Jan. 29, 2019.

*Primary Examiner* — Alexander Krzystan
*Assistant Examiner* — Julie X Dang
(74) *Attorney, Agent, or Firm* — Brundidge & Stanger, P.C.

(57) ABSTRACT

Disclosed is a loudspeaker module, comprising a module housing formed with an accommodation cavity, and a loudspeaker unit accommodated in the accommodation cavity, wherein the loudspeaker unit comprises a magnetic conductive yoke; a through hole which corresponds to the magnetic conductive yoke and penetrates through inner and outer surfaces of the module housing is provided, near the magnetic conductive yoke, on the module housing, and the magnetic conductive yoke extends into the through hole; and an assembly gap is provided between the magnetic conductive yoke and a hole wall of the through hole. The loudspeaker module further comprises a sealing member, wherein a part of the sealing member is adhered to the outer surface of the housing, and the other part is adhered to a bottom surface of the magnetic conductive yoke so as to seal the assembly gap.

12 Claims, 7 Drawing Sheets

(58) Field of Classification Search
CPC ..... H04R 1/288; H04R 1/028; H04R 1/021; H04R 2400/11; H04R 7/20; H04R 7/127; H04R 7/04; H04R 1/323; H04R 9/06; H04R 2307/027; H04R 9/045; H04R 2499/11; H04R 1/2803; H04R 1/025; H04R 2201/029; H04R 31/006; H04R 7/10; H04S 2420/01
USPC ..... 381/150, 176, 423, 162, 349, 353, 400, 381/404, 351, 354, 345, 418, 409, 412, 381/398
See application file for complete search history.

(56) References Cited

U.S. PATENT DOCUMENTS

| | | | | |
|---|---|---|---|---|
| 2016/0127834 | A1 | 5/2016 | Kim et al. | |
| 2016/0241938 | A1* | 8/2016 | Huang | H04R 1/023 |
| 2016/0323675 | A1* | 11/2016 | Dai | H04R 1/38 |

FOREIGN PATENT DOCUMENTS

| | | | |
|---|---|---|---|
| CN | 205864735 | U | 1/2017 |
| CN | 107040851 | A | 8/2017 |
| CN | 207677986 | U | 7/2018 |

* cited by examiner

LOUDSPEAKER MODULE

TECHNICAL FIELD

The present disclosure relates to the technical field of electro-acoustic conversion technology, in particular, to a loudspeaker module.

BACKGROUND ART

A loudspeaker is an important acoustic component in electronic devices. As an energy conversion device that converts electrical signals into acoustic signals, the loudspeaker is widely used in portable electronic devices such as mobile phones, notebook computers, hearing aids, and the like. With the rapid development of these portable electronic devices, functional requirements for the devices are increasing. Up to now, the development trend of the loudspeaker tends to miniaturization and high power, which put forward strict requirements for the volume and heat dissipation capacity of the loudspeaker itself.

The structure of existing loudspeaker module generally includes a module housing and a loudspeaker unit provided inside the module housing, the loudspeaker unit divides an accommodation cavity inside the module housing into a front sound cavity and a rear sound cavity isolated from each other. For a high-power loudspeaker unit, in order to achieve the purpose of reducing the thickness of the module and increasing the heat dissipation capacity, a through hole is provided on the housing in the existing loudspeaker module, so that a part of the magnetic conductive yoke of the loudspeaker unit may occupy a certain space of the module housing in thickness, and the heat dissipation capacity of the loudspeaker unit can be improved after exposing the part of the magnetic conductive yoke of the loudspeaker unit to outside of the module housing. However, the above structure has the following defects: an assembly gap between the magnetic conductive yoke of the loudspeaker unit and the module housing is not protected; sealing with an adhesive is needed; the adhesive is easy to flow into the loudspeaker when it is applied; core components such as a vibrating diaphragm, a voice coil, and the like are contaminated, resulting in poor performance of the loudspeaker. In addition, the adhesive-applying sealing process is time-consuming and labor-intensive, has low efficiency, and cannot guarantee the sealing performance of the rear sound cavity of the loudspeaker module after the adhesive is applied, thus the product yield is low and a second gluing treatment is often required.

Therefore, it is necessary to provide a new structure of the loudspeaker module to overcome the above-mentioned defects in the prior art.

SUMMARY OF THE UTILITY MODEL

In view of the above problems, a technical problem to be solved by the present disclosure is to provide a loudspeaker module, the structure of the loudspeaker module is improved such that a rear sound cavity of the loudspeaker module can be sealed without the need to apply an adhesive to an assembly gap between a magnetic conductive yoke of a loudspeaker unit and a module housing, and the sealing process is simple and reliable, the module assembly efficiency is high, and the product yield is high.

To solve the technical problem above, the present disclosure provides the following technical solution:

A loudspeaker module, including a module housing formed with an accommodation cavity and a loudspeaker unit accommodated in the accommodation cavity, the loudspeaker unit comprises a magnetic conductive yoke;

a through hole is provided on the module housing close to the magnetic conductive yoke, the through hole corresponds to the magnetic conductive yoke and penetrates inner and outer surfaces of the module housing, and the magnetic conductive yoke extends into the through hole;

an assembly gap is provided between the magnetic conductive yoke and a wall of the through hole, the loudspeaker module further includes a sealing member;

a part of the sealing member is adhered to the outer surface of the housing, and another part of the sealing member is adhered to a bottom surface of the magnetic conductive yoke so as to seal the assembly gap.

Further, preferably, along a circumferential direction of the through hole, the outer surface of the module housing is recessed inward to form a concave portion, the concave portion penetrates the wall of the through hole;

An boundary of the sealing member is located inside the concave portion, and an inner surface of the boundary of the sealing member is adhered and fixed to a bottom surface of the concave portion.

Further, preferably, a side surface of the sealing member away from the magnetic conductive yoke is flush with a top edge of a side wall of the concave portion.

Further, preferably, the bottom surface of the magnetic conductive yoke and the outer surface of the module housing are located in a same plane.

Further, preferably, the bottom surface of the magnetic conductive yoke and the bottom surface of the concave portion are located in a same plane.

Further, preferably, the sealing member completely covers the through hole.

Further, preferably, an opening is provided at the middle portion of the sealing member, and a boundary of the opening is located inside a boundary of the bottom surface of the magnetic conductive yoke.

Further, preferably, the module housing at least includes a first housing with an upper opening and a second housing firmly coupled with the opening, the first housing and the second housing form an accommodation cavity for accommodating and securing the loudspeaker unit;

The through hole is formed on the second housing, and the sealing member is located on an outer surface of the second housing.

Further, preferably, the sealing member is a sheet-shaped one-sided tape.

Further, preferably, the sealing member includes a base material layer and an adhesive layer, the base material layer is adhered to the outer surface of the housing and the bottom surface of the magnetic conductive yoke by the adhesive layer.

Wherein, the material of the base material layer is any one or more of silica gel, carbon fiber cloth, plastic, glass, ceramics and graphite; the adhesive layer is a double-sided adhesive or glue.

Advantageous Effects

1. The structure of the loudspeaker module provided by the present disclosure, while keeping the thickness of the loudspeaker module reduced and having good heat dissipation capacity, allows the assembly gap between the loudspeaker unit and the module housing to be sealed without the need to apply an adhesive to the assembly gap, by means of providing a sealing member between the outer side of the module housing and the bottom surface of the magnetic conductive yoke, thus the assembly gap as well as the rear sound cavity of the module are sealed.

2. The structure of the loudspeaker module provided by the present disclosure, through adhesive sealing among the sealing member and the module housing and the magnetic conductive yoke, reduces the difficulty of the sealing process of the rear sound cavity of the module, improves the assembly efficiency of the module, and the volume of the rear sound cavity is greater than that of a rear sound cavity formed by means of applying an adhesive directly to the assembly gap, the sealing effect is better, and the product yield is higher.

3. With the concave portion provided on the module housing, the present disclosure may realize the sealing of the rear sound cavity through the fit between the sealing member and the module housing, without additionally increasing the overall thickness of the module.

4. In the present disclosure, the sealing member uses a one-sided tape, the sealing member can ensure the sealing effect of the rear sound cavity of the module using the sealing performance of the one-sided tape without reducing the heat dissipation capacity of the module when a high-power loudspeaker unit is used in the loudspeaker module; in addition, the lightness and thinness of the one-sided tape does not have an unnecessary impact on the overall thickness of the loudspeaker module.

5. An opening design for the sealing member is also provided in the present disclosure, which may expose a part of the magnetic conductive yoke of the loudspeaker unit to outside of the module housing, for further improving the overall heat dissipation capacity of the loudspeaker module, and not affecting the sealing performance of the rear sound cavity.

BRIEF DESCRIPTION OF THE DRAWINGS

Detailed description of the embodiments of the present disclosure will be further described in detail below with reference to the accompanying drawings.

DETAILED DESCRIPTION OF THE EMBODIMENTS

Figure 1:
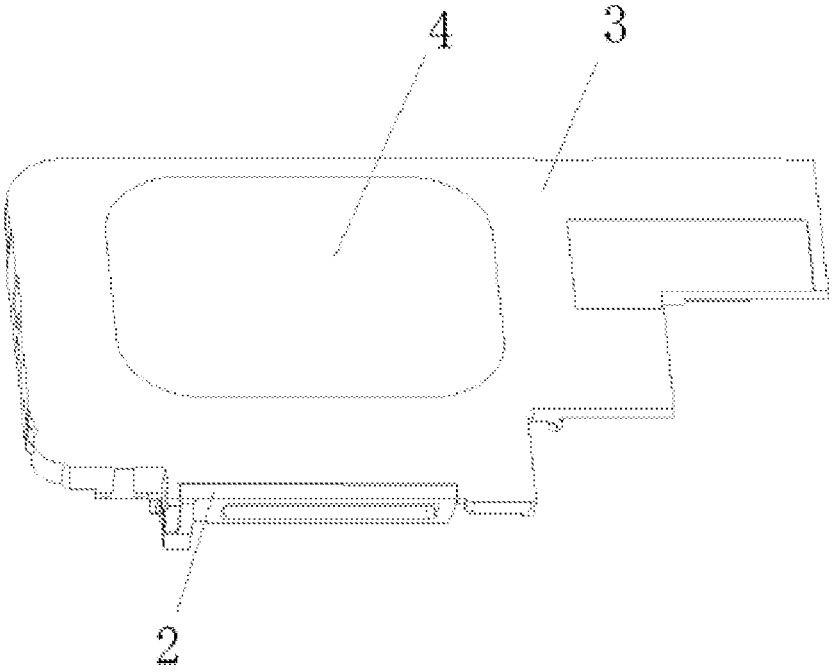
FIG. 1 is a schematic view showing a stereo structure of a loudspeaker module according to an embodiment of the present disclosure.

In order to explain the present disclosure more clearly, the present disclosure will be further described below with reference to preferred embodiments and drawings. Similar components in the drawings are denoted by the same reference numerals. It should be understood by those skilled in the art that, the content specifically described below is illustrative rather than restrictive, and should not be used to limit the protection scope of the present disclosure.

In the following description, for the purpose of illustration, many specific details are set forth to provide a comprehensive understanding of one or more embodiments. However, it is obvious that these embodiments can also be implemented without the specific details. In other examples, well-known structures and devices are shown in a form of block diagrams so as to facilitate description of one or more embodiments.

In order to explain the present disclosure more clearly, the present disclosure will be further described below with reference to preferred embodiments and drawings. Similar components in the drawings are denoted by the same reference numerals. It should be understood by those skilled in the art that, the content specifically described below is illustrative rather than restrictive, and should not be used to limit the protection scope of the present disclosure.

Figure 2:
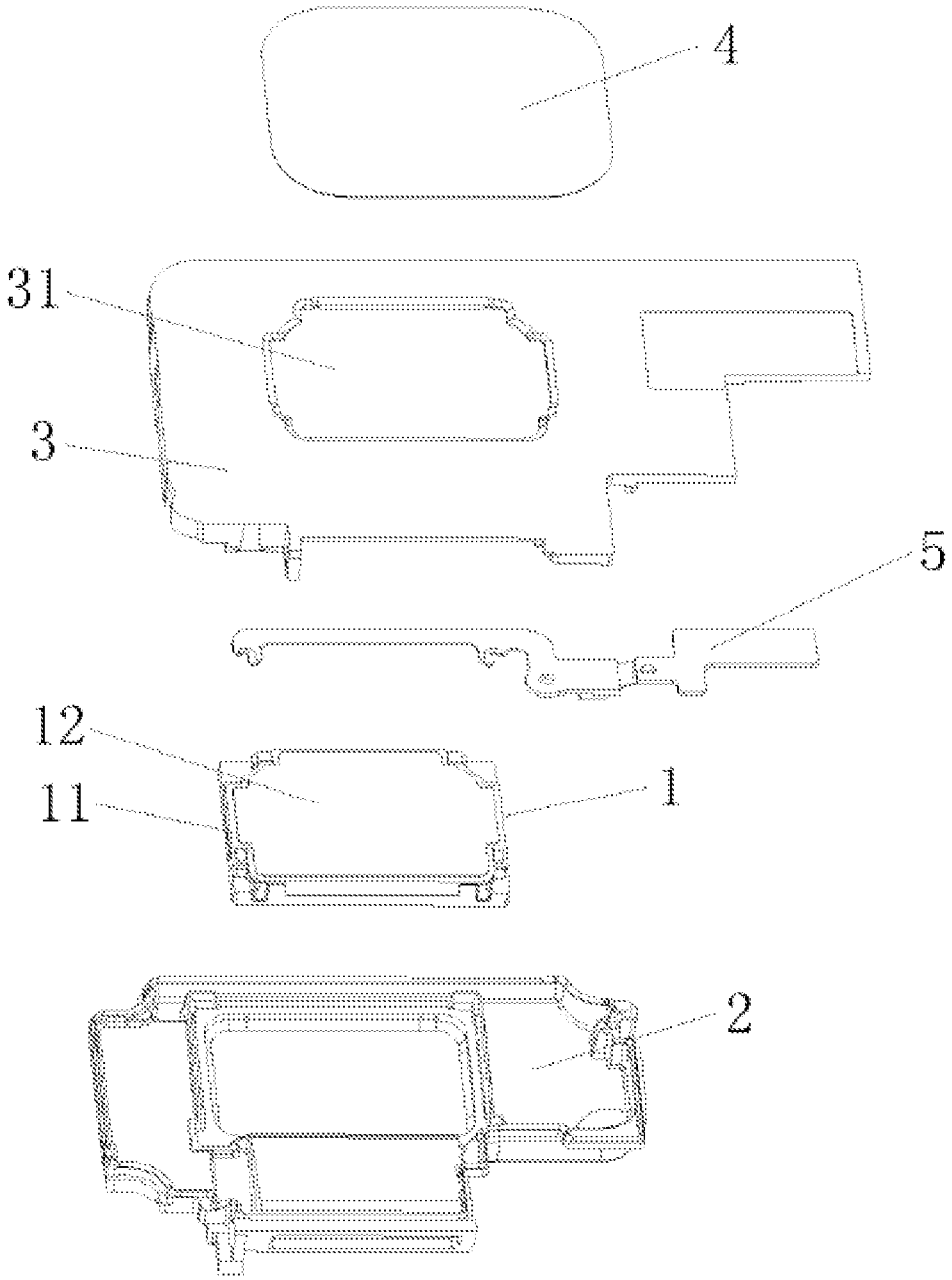
FIG. 2 is a structural assembly view showing the loudspeaker module according to the embodiment of the present disclosure.
Figure 3:
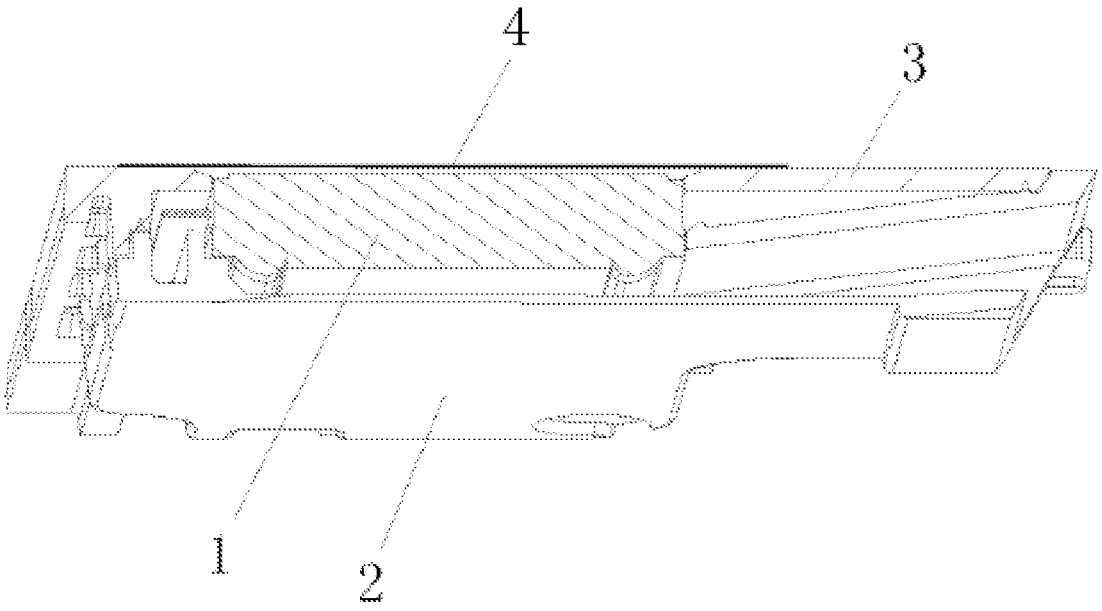
FIG. 3 is a half cross-sectional view showing the loudspeaker module according to the embodiment of the present disclosure.

To solve the problems that, in the existing loudspeaker module, an assembly gap between the magnetic conductive yoke of the loudspeaker unit and the module housing is not protected; sealing with an adhesive is needed; the adhesive is easy to flow into the loudspeaker when it is applied; core components such as a vibrating diaphragm, a voice coil, and the like are contaminated, resulting in poor performance of the loudspeaker, the present disclosure provides a loudspeaker module, in which an assembly gap between a magnetic conductive yoke of a loudspeaker unit and a module housing can be sealed without the need to apply an adhesive to the assembly gap, thus the assembly gap as well as the rear sound cavity of the module are sealed. Further, the sealing process is simple and reliable, the module assembly efficiency is high, and the product yield is high. With reference to FIG. 1 to FIG. 3, in the embodiment, FIG. 1 to FIG. 3 show a specific structure of the loudspeaker module according to an embodiment of the present disclosure. Specifically, the loudspeaker module includes a module housing formed with an accommodation cavity and a loudspeaker unit 1 accommodated in the accommodation cavity. In the illustrated structure, the module housing includes a first housing 2 having an upper opening and a second housing 3 firmly coupled with the opening, the first housing 2 and the second housing 3 form an accommodation cavity for accommodating and securing the loudspeaker unit 1. The loudspeaker unit 1 divides the accommodation cavity into a front sound cavity and a rear sound cavity isolated from each other. It should be noted that, the first housing 2 and the second housing 3 may also be referred to as a module upper housing and a module lower housing, but the present disclosure is not limited thereto.

The loudspeaker unit 1 includes a casing 11, and a vibrating system and a magnetic circuit system accommodated in the casing 11, wherein, the magnetic circuit system includes a magnetic conductive yoke 12 located inside the accommodation cavity and a magnet located on the magnetic conductive yoke, the magnetic circuit system has a magnetic gap; the vibrating system includes a vibrating diaphragm fixed inside the accommodation cavity and a voice coil driving the vibrating diaphragm to produce sound, the voice coil is fixed on the vibrating diaphragm and is suspended in the magnetic gap of the magnetic circuit system; when the voice coil is charged with electricity, the voice coil may vibrate under the action of the magnetic circuit system, and the voice coil drives the vibrating diaphragm to vibrate together to produce sound of the vibrating diaphragm. Correspondingly, the loudspeaker module further includes a flexible circuit board 5 electrically connecting the voice coil and an external circuit of the loudspeaker module; an end of the flexible circuit board 5 away from the voice coil is provided as passing out of the accommodation cavity of the module housing to the outside the module housing. It should be noted that, a specific structure of the magnetic circuit system may be a single magnetic circuit structure or a multi-magnetic circuit structure, that is, the structure of the loudspeaker unit is well known for those skilled in the art, and will not be described in detail herein.

In the embodiment, a through hole 31, which corresponds to the magnetic conductive yoke 12 and penetrates inner and outer surfaces of the second housing 3, is provided on the second housing 3 close to the magnetic conductive yoke 12, the magnetic conductive yoke 12 extends into the through hole 31, and there is an assembly gap is provided between the magnetic conductive yoke 12 and a wall of the through hole 31. In the embodiment, the loudspeaker module further includes a sealing member 4, a part of the sealing member 4 is adhered to an outer surface of the second housing 3, and another part of the sealing member 4 is adhered to a bottom surface of the magnetic conductive yoke 12 so as to seal the assembly gap. Specifically, the sealing member 4 is located on the outer surface of the second housing 3, the sealing member 4 covers the through hole 31, and an inner surface of a boundary of the sealing member 4 is adhered and fixed to the outer surface of the second housing 3, the bottom surface of the magnetic conductive yoke 12 is adhered and fixed to the inner surface of the sealing member 4.

Preferably, the sealing member 4 is a sheet-shaped one-sided tape. The one-sided tape has good sealing performance, which can ensure the sealing effect of the rear sound cavity of the module, and may not reduce the heat dissipation capacity of the module when a high-power loudspeaker unit is used in the loudspeaker module. In addition, the lightness and thinness of the single-sided tape does not have any unnecessary impact on the overall thickness of the loudspeaker module. It should be noted that, the sealing member 4 includes a base material layer and an adhesive layer, the base material layer is adhered to the outer surface of the second housing 3 and the bottom surface of the magnetic conductive yoke 12 by the adhesive layer. Wherein, the material of the base material layer is any one or more of silica gel, carbon fiber cloth, plastic, glass, ceramics and graphite; and the adhesive layer is a double-sided adhesive or glue.

In addition, in order to effectively utilize the space of the module housing in thickness to maximize the effective structure of the loudspeaker unit, preferably, the bottom surface of the magnetic conductive yoke 12 and the outer surface of the second housing 3 are located in a same plane. The structure of the loudspeaker module provided by the present disclosure, while keeping the thickness of the loudspeaker module reduced and having good heat dissipation capacity, allows the assembly gap between the loudspeaker unit and the module housing to be sealed without the need to apply an adhesive to the assembly gap by means of providing a sealing member between the outer side of the module housing and the bottom surface of the magnetic conductive yoke, thus the assembly gap as well as the rear sound cavity of the module are sealed; and reduces the difficulty of the sealing process and improves the assembly efficiency of the module. According to the sealing structure of the housing provided in the embodiment, the volume of the rear sound cavity of the module may be greater than that of a rear sound cavity formed by means of applying an adhesive directly to the assembly gap, the sealing effect is good and the product yield is high.

Figure 4:
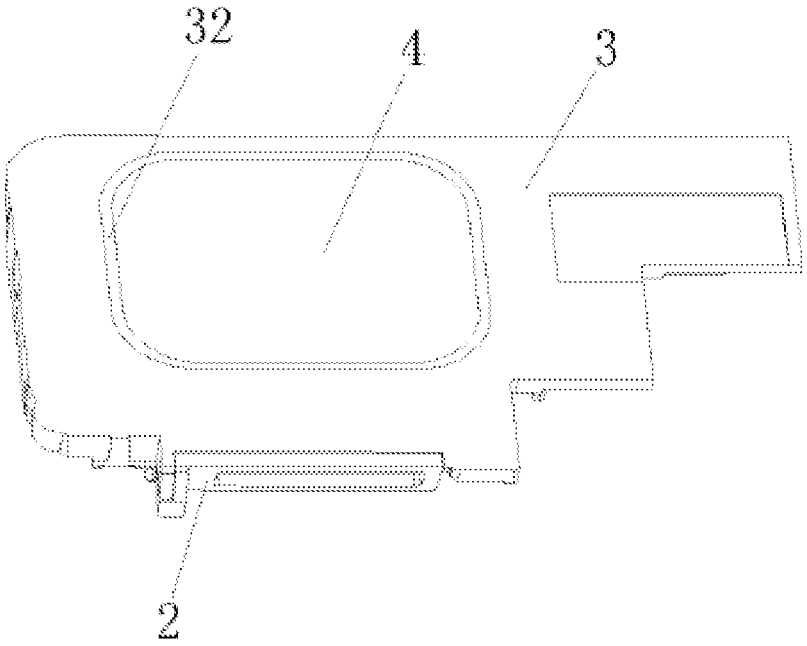
FIG. 4 is a schematic view showing a stereo structure of a loudspeaker module according to a preferred embodiment of the present disclosure.
Figure 5:
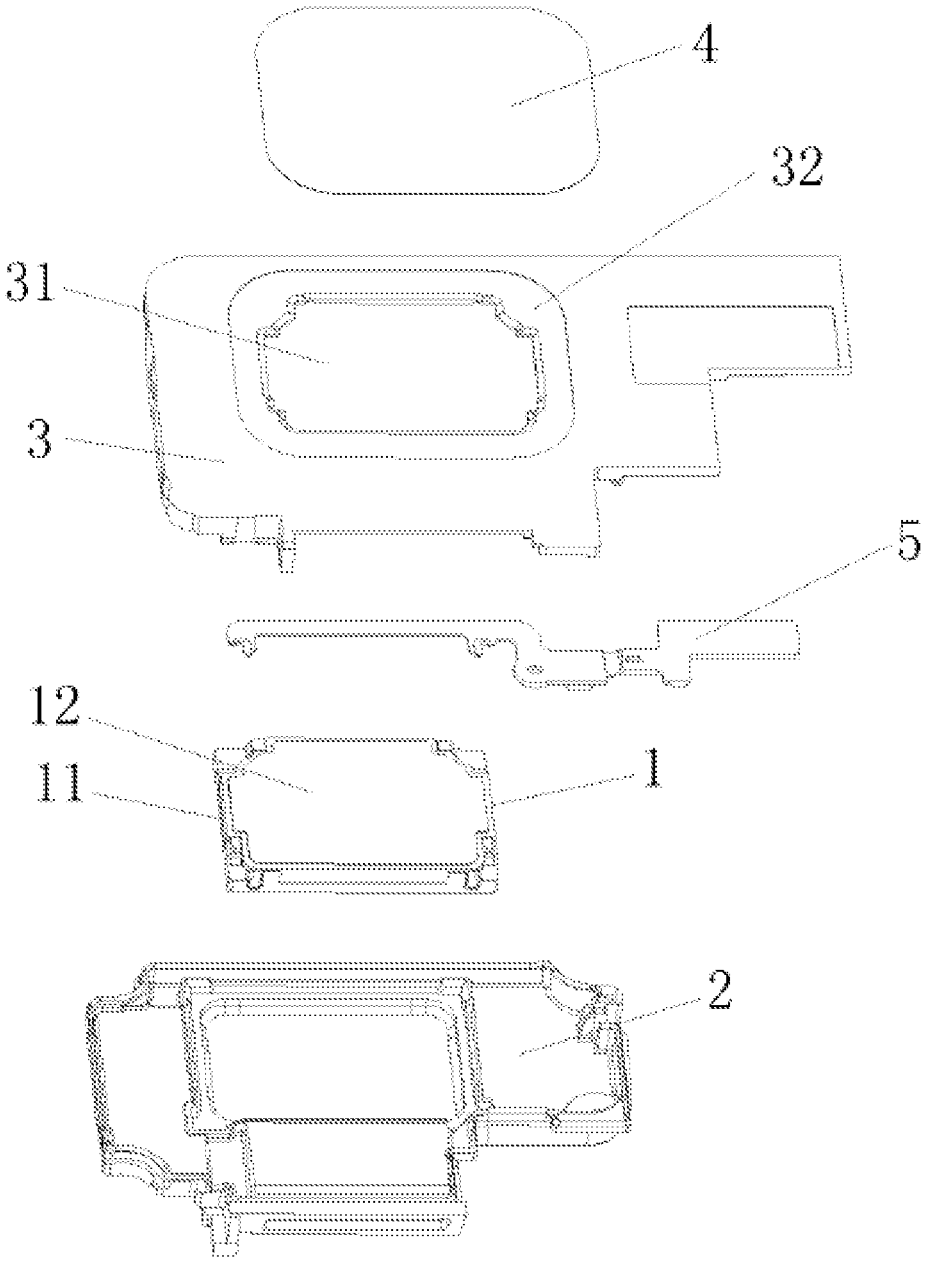
FIG. 5 is a structural assembly view showing the loudspeaker module according to the preferred embodiment of the present disclosure.
Figure 6:
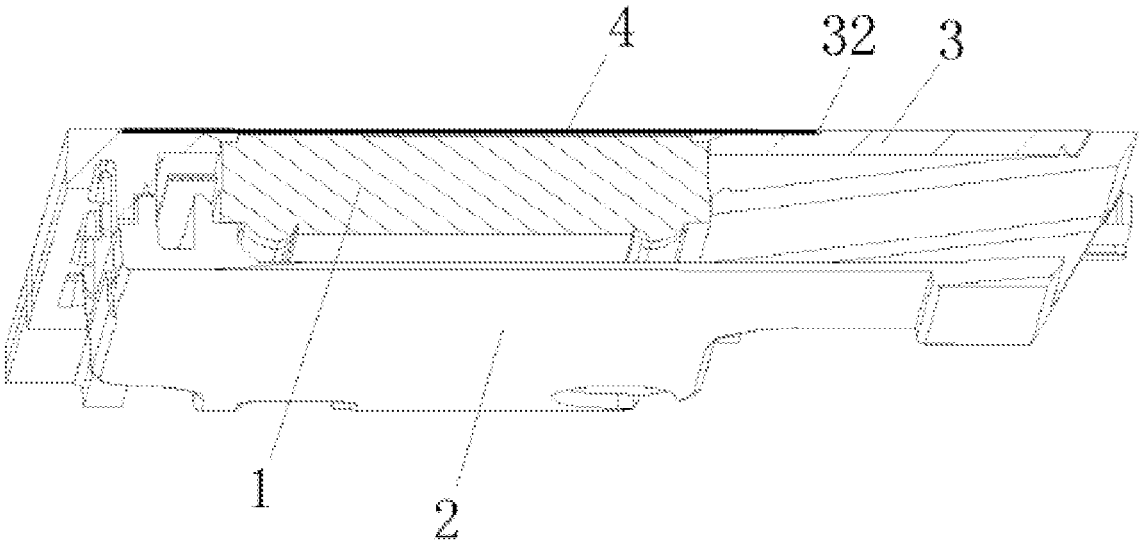
FIG. 6 is a half cross-sectional view showing the loudspeaker module according to the preferred embodiment of the present disclosure.

With reference to FIG. 4 to FIG. 6, the present disclosure also provides a preferred structure of the loudspeaker module, which, specifically, differs from the above embodiment in that: in the embodiment, along a circumferential direction of the through hole 31, the outer surface of the second housing 3 is recessed inward to form a concave portion 32, the concave portion 32 penetrates the wall of the through hole 31; the boundary of the sealing member 4 is located inside the concave portion 32, and an inner surface of the boundary of the sealing member 4 is adhered and fixed to a bottom surface of the concave portion 32. Further, preferably, a side surface of the sealing member 4 away from the magnetic conductive yoke 12 is flush with a top edge of the side wall of the concave portion 32. In the embodiment, with the concave portion 32 provided on the module housing, the sealing of the assembly gap as well as the sealing of the rear sound cavity of the module can be realized through the fit between the sealing member 4 and the second housing 3, without additionally increasing the overall thickness of the module.

Further, preferably, the bottom surface of the magnetic conductive yoke 12 and the bottom surface of the concave portion 32 are located in a same plane. Thus, the space of the module housing in thickness can be effectively utilized to maximize the effective structure of the loudspeaker unit, and the combination and fixation between the magnetic conductive yoke and the sealing member can be facilitated.

Figure 7:
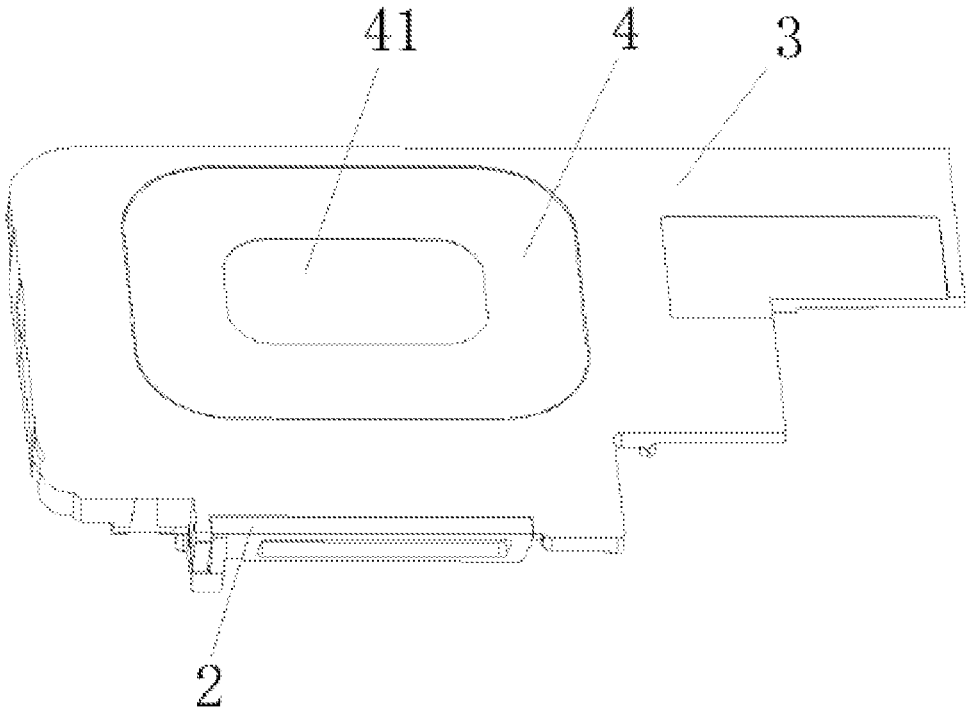
FIG. 7 is a schematic view showing a stereo structure of a loudspeaker module according to another preferred embodiment of the present disclosure.
Figure 8:
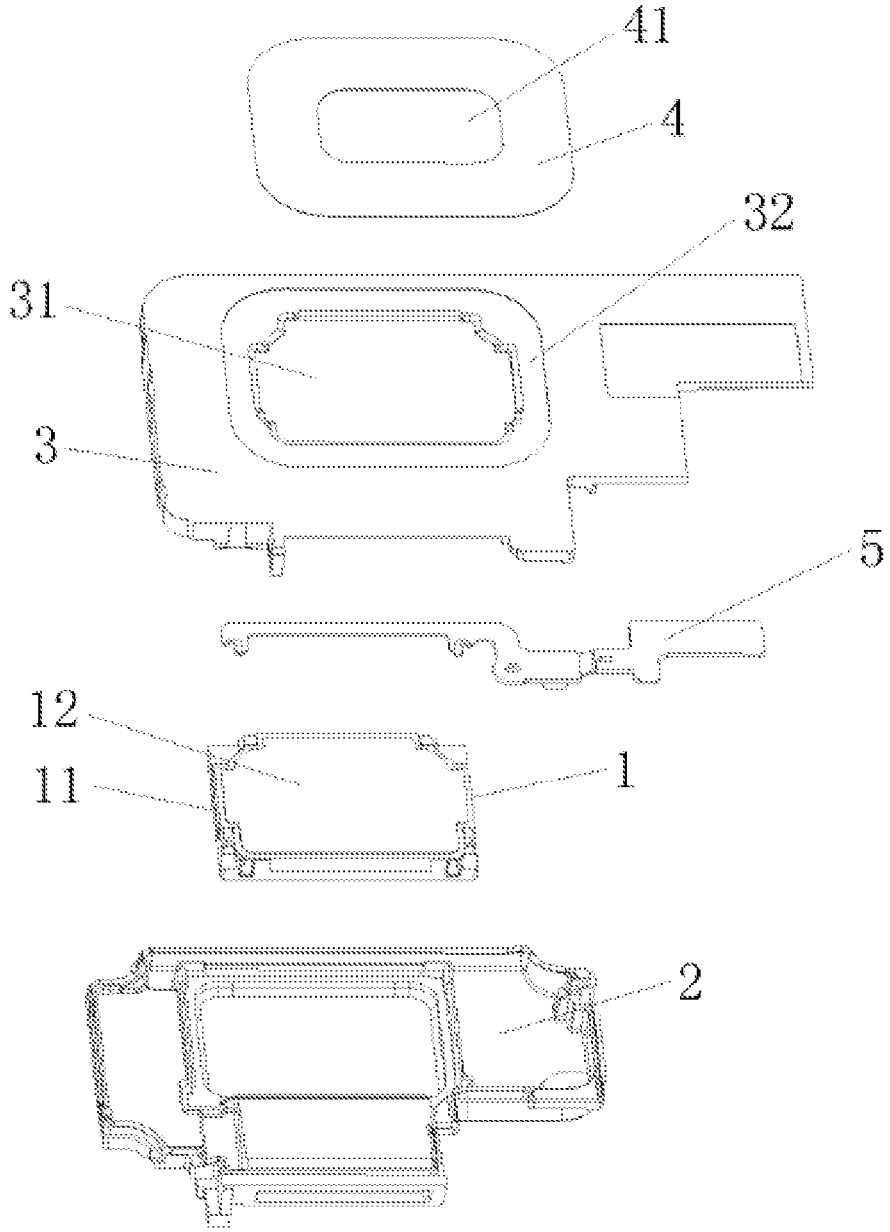
FIG. 8 is a structural assembly view showing the loudspeaker module according to another preferred embodiment of the present disclosure.
Figure 9:
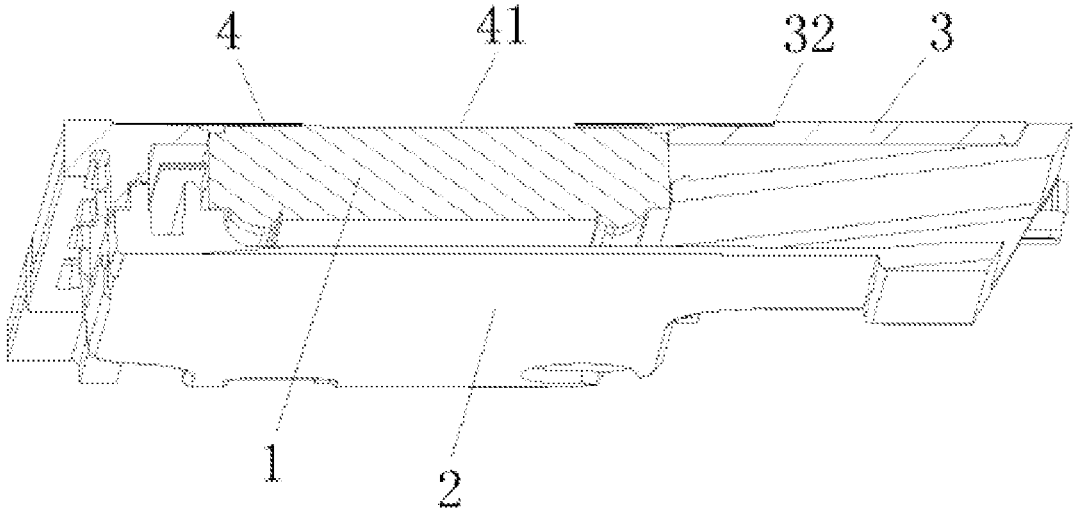
FIG. 9 is a half cross-sectional view showing the loudspeaker module according to another preferred embodiment of the present disclosure.

In addition, with reference to FIG. 7 to FIG. 9, the present disclosure also provides another preferred structure of the loudspeaker module. Specifically, in the embodiment, an opening 41 is provided at a middle portion of the sealing member 4 on the basis of the structure of the loudspeaker module provided in the above two embodiments, and a boundary of the opening 41 is located inside a boundary of the bottom surface of the magnetic conductive yoke 12. In the embodiment, the sealing member 4 is opened at the middle portion, which may expose the bottom surface of a part of the magnetic conductive yoke 12 of the loudspeaker unit to outside of the module housing from the accommodation cavity of the loudspeaker module via the through hole 31, for further improving the overall heat dissipation capacity of the loudspeaker module. In addition, an inner surface of the sealing member 4 at the boundary of the opening 41 is adhered and fixed to the bottom surface of the magnetic conductive yoke 12, thereby realizing the sealing of the assembly gap between the magnetic conductive yoke and the module housing as well as the sealing of the rear sound cavity of the module. It should be noted that, FIG. 7 to FIG. 9 specifically illustrate an assembly structure including a sealing member with an opening by taking the structure of the loudspeaker module in which a concave portion is included on the second housing as an example, however, it should be understood by those skilled in the art that, the sealing member with an opening may also be applied to the structure of the loudspeaker module as shown in FIG. 1 to FIG. 3, but the present disclosure is not limited thereto.

It can be seen from the above embodiments that, the structure of the loudspeaker module provided by the present disclosure, while keeping the thickness of the loudspeaker module reduced and having good heat dissipation capacity, realizes the sealing structure of the assembly gap between the magnetic conductive yoke of the loudspeaker unit and the module housing as well as the sealing structure of the rear sound cavity of the module by means of providing the sealing member between the outer side of the module housing and the bottom surface of the magnetic conductive yoke. Further, the structure of the loudspeaker module provided by the present disclosure avoids occurrence of technical problems, such as, the assembly gap being not protected, sealing with an adhesive being needed, the adhesive being easy to flow into the loudspeaker when applied, core components such as a vibrating diaphragm, a voice coil, and the like being contaminated, resulting in poor performance of the loudspeaker. The structure of the loudspeaker module provided by the present disclosure also reduces the difficulty of the sealing process of the rear sound cavity of the module, improves the assembly efficiency of the module, the sealing effect is good and the product yield is high.

Obviously, the above-mentioned embodiments of the present disclosure are only examples for clearly illustrating the present disclosure, but not for limiting the embodiments of the present disclosure. For those skilled in the art, other changes or modifications in different forms can be made on the basis of the above description. It is not possible to exhaustively list all the embodiments here, all the obvious changes or modifications derived from the technical solutions of the present disclosure are included in the protection scope of the present disclosure.

What is claimed is:

1. A loudspeaker module, comprising:

a module housing formed with an accommodation cavity; and a loudspeaker unit accommodated in the accommodation cavity, which comprises a magnetic conductive yoke, wherein a through hole is provided on the module housing close to the magnetic conductive yoke, the through hole corresponds to the magnetic conductive yoke and penetrates inner and outer surfaces of the module housing, and the magnetic conductive yoke extends into the through hole, wherein an assembly gap is provided between the magnetic conductive yoke and a wall of the through hole, the loudspeaker module further comprises a sealing member, and wherein a part of the sealing member is adhered to the outer surface of the module housing, and another part of the sealing member is adhered to a bottom surface of the magnetic conductive yoke so as to seal the assembly gap.

2. The loudspeaker module of claim 1, wherein, along a circumferential direction of the through hole, the outer surface of the module housing is recessed inward to form a concave portion, the concave portion penetrates the wall of the through hole; and a boundary of the sealing member is located inside the concave portion, and an inner surface of the boundary of the sealing member is adhered and fixed to a bottom surface of the concave portion.

3. The loudspeaker module of claim 2, wherein a side surface of the sealing member away from the magnetic conductive yoke is flush with a top edge of a side wall of the concave portion.

4. The loudspeaker module of claim 1, wherein, the bottom surface of the magnetic conductive yoke and the outer surface of the module housing are located in a same plane.

5. The loudspeaker module of claim 2, wherein the bottom surface of the magnetic conductive yoke and the bottom surface of the concave portion are located in a same plane.

6. The loudspeaker module of claim 1, wherein the sealing member completely covers the through hole.

7. The loudspeaker module of claim 1, wherein, an opening is provided at a middle portion of the sealing member, and a boundary of the opening is located inside a boundary of the bottom surface of the magnetic conductive yoke.

8. The loudspeaker module of claim 1, wherein the module housing at least comprises a first housing with an upper opening and a second housing firmly coupled with the opening, the first housing and the second housing form the accommodation cavity for accommodating and securing the loudspeaker unit; and wherein the through hole is formed on the second housing, and the sealing member is located on an outer surface of the second housing.

9. The loudspeaker module of claim 1, wherein the sealing member is a sheet-shaped one-sided tape.

10. The loudspeaker module of claim 1, wherein the sealing member comprises a base material layer and an adhesive layer, the base material layer is adhered to the outer surface of the module housing and the bottom surface of the magnetic conductive yoke by the adhesive layer.

11. The loudspeaker module of claim 10, wherein the material of the base material layer is any one or more of silica gel, carbon fiber cloth, plastic, glass, ceramics and graphite.

12. The loudspeaker module of claim 10, wherein the adhesive layer is a double-sided adhesive or glue.

* * * * *